US005564398A

United States Patent [19]

Maeda et al.

[11] Patent Number: 5,564,398

[45] Date of Patent: Oct. 15, 1996

[54] SIMPLIFIED CANISTER FOR PREVENTION OF ATMOSPHERIC DIFFUSION OF FUEL VAPOR FROM A VEHICLE

[75] Inventors: Kazuto Maeda, Aichi-gun; Nobuhiko Koyama, Nagoya; Hiroshi Tamura, Kariya; Junya Morikawa, Kasugai, all of Japan

[73] Assignee: Nippondenso Co., Ltd., Kariya, Japan

[21] Appl. No.: 317,365

[22] Filed: Oct. 4, 1994

[30] Foreign Application Priority Data

Oct. 5, 1993 [JP] Japan ..... 5-249115
Dec. 22, 1993 [JP] Japan ..... 5-324741

[51] Int. Cl.[6] ..... F02M 37/04

[52] U.S. Cl. ..... 123/520; 123/519

[58] Field of Search ..... 123/198 D, 520, 123/521, 518, 519, 516

[56] References Cited

U.S. PATENT DOCUMENTS

| | | | |
|---|---|---|---|
| 4,815,436 | 3/1989 | Sasaki | 123/520 |
| 4,862,856 | 9/1989 | Yokoe | 123/520 |
| 5,209,210 | 5/1993 | Ikeda | 123/520 |
| 5,337,721 | 8/1994 | Kasuya | 123/519 |
| 5,398,660 | 3/1995 | Koyama | 123/520 |
| 5,408,976 | 4/1995 | Reddy | 123/520 |

FOREIGN PATENT DOCUMENTS

| | | | |
|---|---|---|---|
| 0029761 | 2/1984 | Japan | 123/520 |
| 1132763 | 6/1986 | Japan | 123/519 |
| 0159455 | 6/1989 | Japan | 123/519 |
| 5-231249 | 9/1993 | Japan | 123/519 |
| 6074107 | 3/1994 | Japan | 123/519 |

*Primary Examiner*—Carl S. Miller
*Attorney, Agent, or Firm*—Cushman, Darby & Cushman

[57] ABSTRACT

A canister for preventing diffusion of fuel vapor to atmosphere is disclosed herein. The canister includes a first case having an adsorbent material, such as activated charcoal, therein and a second case also having an adsorbent material therein. The two cases are joined by a passage having a valve disposed therein. The valve regulates the airflow between the two cases. The first case is connected to the valve, a gas tank, and an engine, while the second case is connected to the valve and to atmosphere. During a refueling operation, the valve is operated so as to allow air to flow from the tank, through the first case and out to the atmosphere through the valve, without passing through the second case.

12 Claims, 9 Drawing Sheets

SIMPLIFIED CANISTER FOR PREVENTION OF ATMOSPHERIC DIFFUSION OF FUEL VAPOR FROM A VEHICLE

CROSS REFERENCE TO RELATED APPLICATIONS

The present invention is based on and claims priority from Japanese Applications 5-249115 filed Oct. 5, 1993 and 5-324741 filed Dec. 22, 1993, the subject matter of both being hereby incorporated herein by reference.

BACKGROUND OF THE INVENTION

1. Field of the Invention

The present invention relates to a canister for a vehicle. More particularly, the present invention relates to a canister for use with a fuel tank to prevent fuel vapor diffusion into the atmosphere.

2. Related Art

Recently, from the viewpoint of environmental protection, the air, including the fuel vapor, produced when refueling need to be adsorbed by means of an adsorbent within a canister. Such adsorption prevents diffusion of fuel vapor into the atmosphere.

Incidentally, in a conventional canister for a vehicle such as that disclosed in U.S. Pat. No. 4,951,643, to increase the adsorption efficiency of the canister when not refueling, in other words, to decrease the air leakage rate of fuel vapor, extending the adsorbent in the channel or flow direction has been effective. In addition, as the fuel vapor is adsorbed and the amount thereof decreased gradually from the end portion on the fuel tank side of the adsorbent, it has proven effective, concerning both increasing adsorption efficiency and miniaturizing the canister, to design a channel cross-sectional area of the adsorbent into a shape wider at the side of the fuel tank and narrower on the side of the atmosphere. However, if either extending the adsorbent in the channel direction or designing the cross-sectional area of the channel mentioned above is performed in order to decrease the air leakage rate of fuel vapor when not refueling, the channel resistance of the canister is increased.

To prevent fuel vapor diffusion into the atmosphere when refueling, it is necessary to treat a flow rate of air including fuel vapor, thirty liters per minute, for example, by means of the canister. However, because the aforementioned canister, which adsorbs fuel vapor when not refueling (hereinafter referred to as a canister for an evaporator), produces a large resistance for the reason described above, such a large quantity of air including fuel vapor can not be effectively handled. Accordingly, taking R for a channel resistance of the canister and Q for a flow rate of the air including the fuel vapor when refueling (refueling flow rate), a positive pressure, corresponding to a pressure loss in the canister, $R \times Q$, is generated in the fuel tank, and if the value of the pressure loss is greater than a predetermined pressure, the autostop of the refueling device operates to make refueling impossible.

SUMMARY OF THE INVENTION

The present invention has been developed in view of the above problem. An object of the present invention is to provide a canister for a vehicle which avoids a complex structure and control, and which is able to prevent atmospheric diffusion of the fuel vapor during both refueling and not refueling.

A canister for a vehicle according to the present invention comprises a case with an inner space disposed therein. A suction passage communicating hole provides communication between the inner space and a suction passage of the engine. A fuel tank communicating hole communicates the inner space with a fuel tank. The inner space also communicates with the atmosphere with an atmosphere communicating hole. An inner adsorption portion, including an adsorbent that adsorbs the fuel vapor, is disposed in the case and separates the suction passage communicating hole and fuel tank communicating hole from the atmosphere communicating hole. An outer adsorption portion, also including an adsorbent that adsorbs the fuel vapor, is disposed in the case so as to separate the inner adsorption portion from the atmosphere communicating hole. Valve means link the inner portion in both the inner and outer adsorption portions with the atmosphere when refueling to the fuel tank. The valve means may be either an electromagnetic valve or a check valve that opens at a predetermined positive pressure.

The case may include an inner case including the inner adsorption portion, an outer case including the outer adsorption portion, and a connecting pipe which connects the inner case and the outer case and is equipped with the valve means.

Furthermore, the inner space may be divided into multilocular structures, with adjoining structure communicating with one another. The case may include the suction passage communicating hole, fuel tank communicating hole, and atmosphere communicating hole at the side of one end face and have the valve means on the opposite side of the end face.

Also, the outer adsorption portion may have a larger channel resistance than does the inner adsorption portion. A s described above, the inner space of the case communicates with a suction passage communicating hole, a fuel tank communicating hole, and an atmosphere communicating hole. At the sides of the suction passage communicating hole and the fuel tank communicating hole, an inner adsorption portion for adsorbing fuel vapor is disposed, and an outer adsorption portion for adsorbing fuel vapor is disposed on the side of the atmosphere communicating hole in the inner space. The inner space between both of the adsorption portions communicates with the atmosphere through the valve means during refueling. The valve means is closed so that both of the adsorption portions are serially-connected when not refueling. For this reason, the length in the channel direction of the adsorbent is extended, allowing for an excellent adsorption efficiency to be obtained.

Since the valve means is open when refueling, the channel direction of the outer adsorption portion is bypassed by means of this valve means so that the channel resistance of the canister is nearly equal to the channel resistance of the inner adsorption portion. As stated above, as the inner adsorption portion is made larger than the cross-sectional area so that the inner adsorption portion may adsorb a greater quantity of fuel vapor than the outer adsorption portion, the channel resistance is small. Thus, the canister can handle large amounts of air including fuel vapor during refueling and adsorb the fuel vapor at the canister when not refueling.

Furthermore, a canister of the present invention has as an advantage that it is simple in structure and control and easy to use in practice.

BRIEF DESCRIPTION OF THE DRAWINGS

Other objects, features and characteristics of the present invention as well as the functions of related parts will become clear from a study of the following detailed description, the appended claims, and the drawings. In the drawings:

DETAILED DESCRIPTION OF THE PRESENTLY PREFERRED EXEMPLARY EMBODIMENTS

Figure 1:
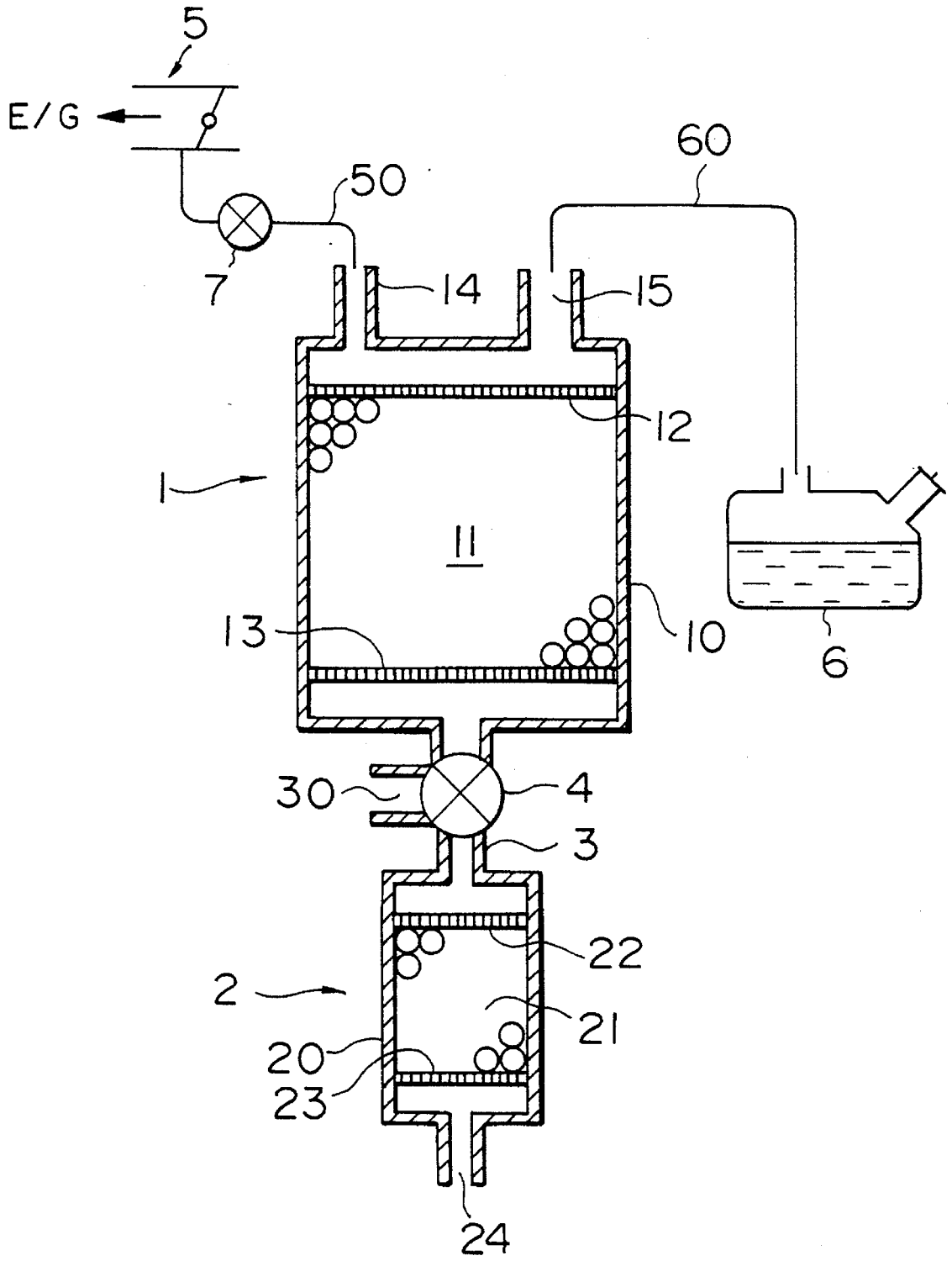
FIG. 1 is a schematic cross sectional view of the first embodiment of the present invention.

The first embodiment of a canister for a vehicle according to the present invention will be described below with reference to FIG. 1.

This canister for a vehicle includes canister 1, canister 2, connecting pipe 3 which communicates canisters 1 and 2, and switching valve (hereinafter referred to as valve means) 4 that is disposed in connecting pipe 3.

Canister 1 includes large cylindrical case (referred to as an inner case) 10 with inner adsorption portion 11 disposed therein. Inner adsorption portion 11 contains the adsorbent, which is made of charcoal, and is separated from both of the end faces of case 10 by certain intervals by means of porous bulkheads 12 and 13.

Canister 2 includes small cylindrical case (referred to as an outer case) 20 with outer adsorption portion 21 disposed therein. Outer adsorption portion 21 also contains adsorbent, which is made of charcoal, and is separated from both of the end faces of case 20 by certain intervals by means of porous bulkheads 22 and 23.

On the upper end face of canister 1, suction passage communicating hole 14, which communicates with a suction passage of engine 5 through conduit 50, and fuel tank communicating hole 15, which communicates with fuel tank 6 through conduit 60, open. In addition, purge valve 7, which includes an electromagnetic proportional control valve that controls the flow rate of fuel vapor, for example, to the engine, is disposed in conduit 50.

Further, on the bottom end face of canister 2, an atmosphere communicating hole 24, which communicates with the atmosphere, is formed.

Connecting pipe 3 communicates with the middle portion of the bottom end face of case 10 and the middle portion of the top end face of case 20. Branch pipe 30, which opens to the atmosphere, branches off at the middle portion of connecting pipe 3.

Switching valve 4 is an electromagnetic cross valve, which allows communication between canister 2 and one side of branch pipe 30 and canister 1. It is possible for switching valve 4 to be manually operated, or it is possible for switching valve 4 to be automatically operated by a controller. Additionally, switching valve 4 can be a device such as a switching damper.

Further, cases 10 and 20 and connecting pipe 3 compose a case of the present invention.

Next, the operation of the above-mentioned canister for a vehicle will be described below.

Switching valve 4 communicates with both canisters 10 and 20, and branch pipe 30 is shut off when not refueling. When engine operation is stopped, as the temperature of fuel tank 6 rises, the internal pressure of fuel tank 6 increases, allowing fuel vapor to flow into canister 1 through conduit 60. The fuel vapor is adsorbed first at inner adsorption portion 11, with the rest of the fuel vapor being adsorbed at the outer adsorption portion 21. If the temperature of fuel tank 6 is then decreased, the internal pressure of fuel tank 6 decreases, the atmosphere which flows in from atmosphere communicating hole 24 eliminates the fuel vapor from both adsorption portions 11 and 21 and forces the fuel vapor into fuel tank 6.

When operating the engine, the atmosphere is drawn from the atmosphere communicating hole 24 through canisters 1 and 2 by the vacuum generated by suction passage 5 of the engine. The fuel vapor which is adsorbed in adsorption portions 11 and 21 at this time is eliminated, and then burned in the engine. At this moment, purge valve 7 controls the flow rate of the fuel vapor at a reasonable rate so as to prevent harmful effects to the engine operation. The control of purge valve 7 is operated by the engine controller which is not shown in the figures, and description of the control is omitted because it is not of great importance in the present invention.

Next, the operation when refueling will be described below. The outlet of canister 1 communicates with branch pipe 30 by switching switching valve 4 when refueling. After refueling into fuel tank 6, the air including the fuel vapor from fuel tank 6 flow into canister 1. The fuel vapor is adsorbed in canister 1, and only the air including a very little amount of the fuel vapor is discharged from branch pipe 30 to the atmosphere through switching valve 4.

At this moment, as canister 1 is large-sized and has low channel resistance, the air in fuel tank 6 is smoothly discharged through canister 1. In other words, the channel resistance of the inner adsorption portion is set to the level possible to discharge the air in fuel tank 6 while refueling.

As explained above, because canister 1 and canister 2 are connected in series so that the length of the channel direction of the adsorption portion is extended, the adsorption efficiency of the fuel vapor can be thoroughly improved and prevent the leakage of the fuel vapor to the atmosphere.

In addition, as most of the fuel vapor is adsorbed in canister 1, canister 2 can be small-sized. That is to say, the constitution of the canister for a vehicle can be miniaturized, and yet the fuel vapor when refueling can be adsorbed in the canister for a vehicle. Furthermore, clearance is disposed between both of canisters 1 and 2 so that the diffusion of the fuel vapor from the adsorption portion 1 to the adsorption portion 2 can be reduced.

Figure 2:
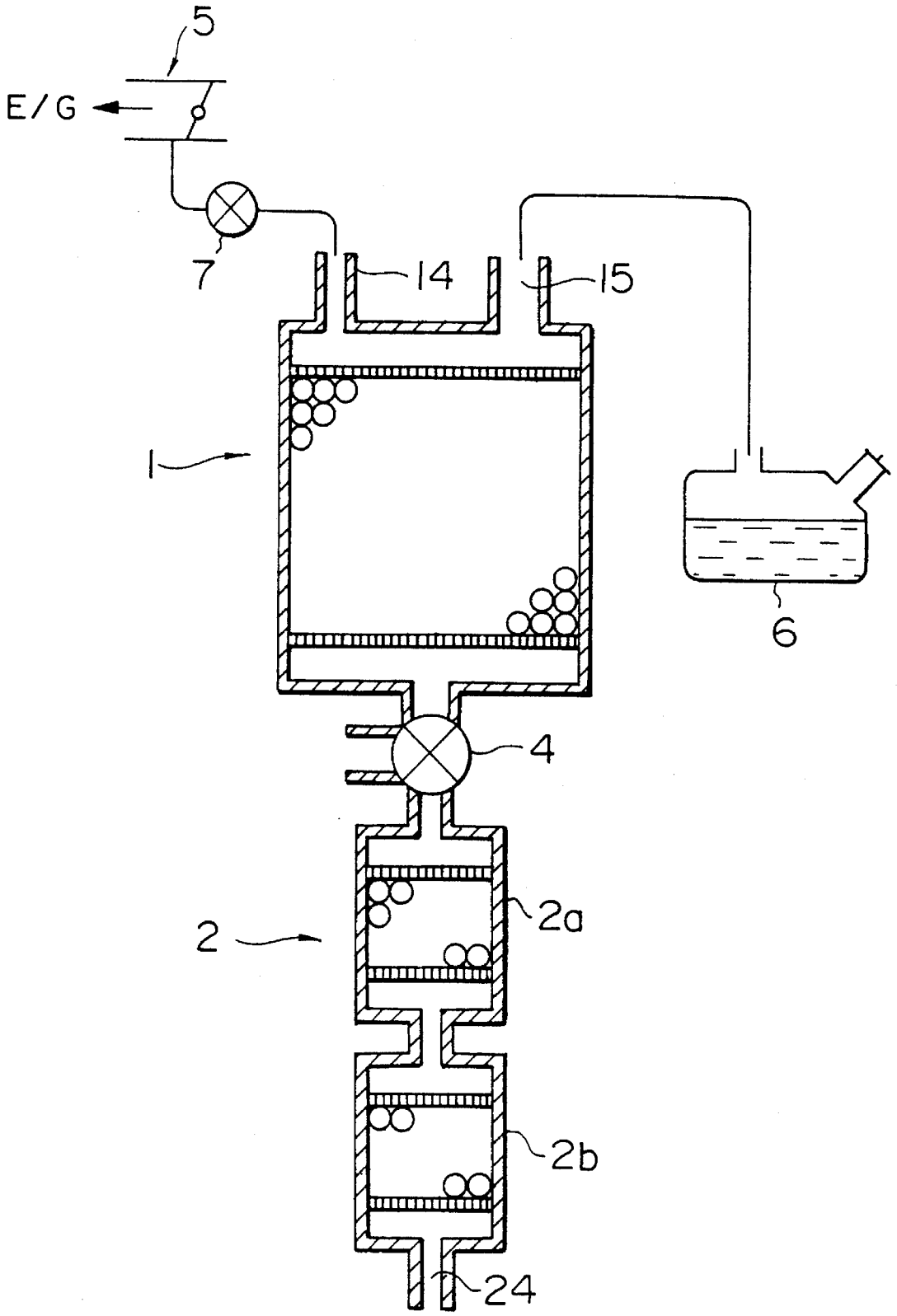
FIG. 2 is a schematic cross sectional view of the second embodiment of the present invention.

Another embodiment of a canister for a vehicle will be described below with reference to FIG. 2. Like elements are represented by like reference numerals.

In the second embodiment, the present invention is structured having canister 2 formed by connecting canister 2*a* to canister 2*b* in series so that the leakage of the fuel vapor when not refueling can be further reduced.

Figure 3:
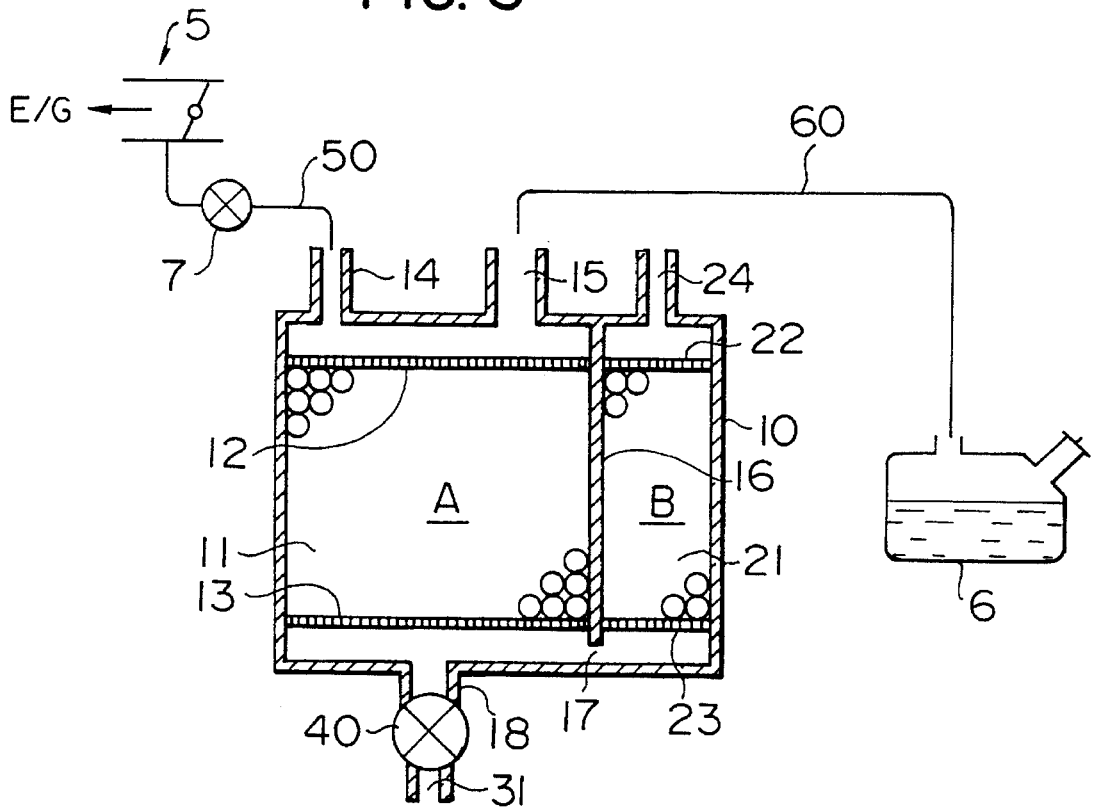
FIG. 3 is a schematic cross sectional view of the third embodiment of the present invention.

The third embodiment of a canister for a vehicle will be described below with reference to FIG. 3. Again, like elements are represented by like reference numerals.

The canister for a vehicle according to the third embodiment in the present invention comprises a case 10 wherein an inner adsorption portion 11 and an outer adsorption portion 21 are separated by inner bulkhead 16.

Inner bulkhead 16 divides the inner space into two parts: an inner space A for holding an inner adsorption portion shown in the left side of the figure and an inner space B for holding an outer adsorption portion shown in the right side of the figure. In the inner space A, inner adsorption portion 11 is set apart by an appointed interval from both end faces of the case 10 by means of the porous bulkheads 12 and 13, and the outer adsorption portion 21 is set apart at an appointed interval from both end faces of the case 10 in the inner space B by means of the porous bulkheads 22 and 23. Communicating hole 17 which communicates between both of the inner spaces A and B is disposed in the bottom portion of the inner bulkhead 16.

In the figures, suction passage communicating hole 14 and fuel tank communicating hole 15 are open at the side of inner space A on the upper end face of case 10, and atmosphere communicating hole 24 is open at the side of inner space B on the upper end face of case 10. In addition, at the bottom face of case 10, communicating pipe 18, which communicates to the atmosphere, is disposed and includes electromagnetic valve means 40.

The operation of this canister for a vehicle of the third embodiment is basically same as that of the first embodiment except that electromagnetic valve means 40 is closed when not refueling and open when refueling.

For this reason, fuel tank 6 communicates with the atmosphere through adsorption portion 11 and communicating pipe 18 when refueling and communicates with the atmosphere through adsorption portions 11 and 21 when not refueling.

Figure 4:
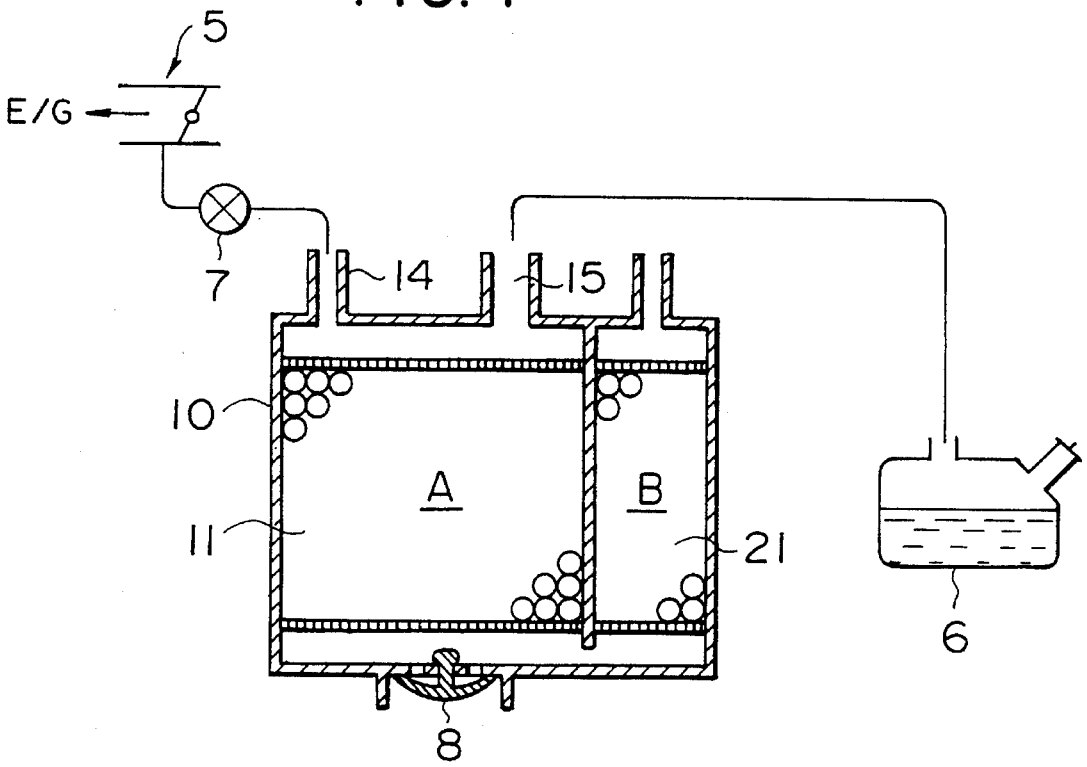
FIG. 4 is a schematic cross sectional view of the fourth embodiment of the present invention.

The fourth embodiment of the present invention will be described below with reference to FIG. 4, where like reference numerals represent like elements.

This canister for a vehicle is the canister for a vehicle according to the third embodiment where electromagnetic valve means 40 is replaced by check valve 8.

Check valve 8, which is formed from rubber, is closed when not refueling and opened by the positive pressure of fuel tank 6 when refueling so that the inner space A can communicate with the atmosphere.

Figure 5:
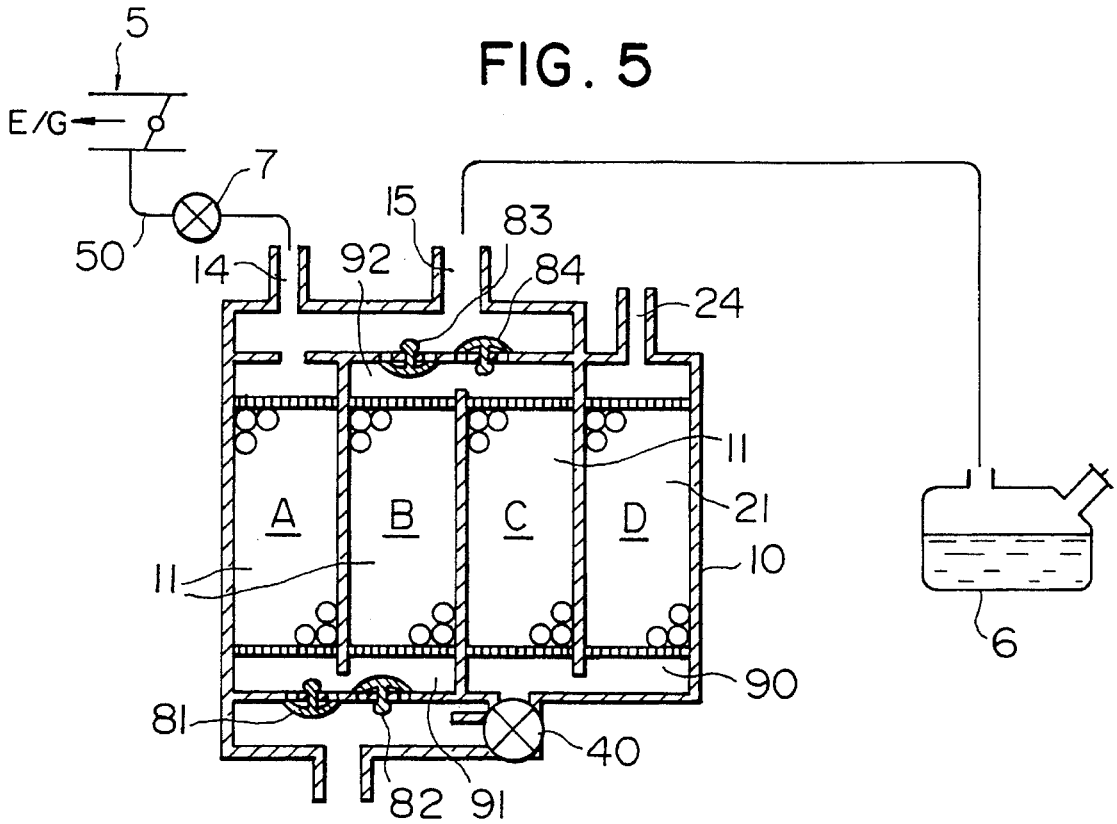
FIG. 5 is a schematic cross sectional view of the fifth embodiment of the present invention.

The fifth embodiment of the present invention will be described with reference to FIG. 5, again where like elements are represented by like reference numerals.

This canister for a vehicle of the fifth embodiment includes case 10 in which the inner space is divided into four adsorption chambers A to D, which communicate one after another serially.

Suction passage communicating hole 14 and tank communicating hole 15 communicate with adsorption chamber A, adsorption chamber B, adsorption chamber C, and adsorption chamber D in that order, then lead to atmosphere communicating hole 24.

Each of the adsorption chambers A to D contains adsorbent, which is composed of activated charcoal. The adsorbent in the adsorption chambers A to C composes inner adsorption portion 11 of the present invention, and the adsorbent in the adsorption chamber D composes outer adsorption portion 21.

Then gap (clearance) 90 which communicates between adsorption chamber C and adsorption chamber D is communicated to the atmosphere through switching valve 40 which is composed of the electromagnetic valve means. The operation of switching valve 40 is equivalent to the operation of the switching valve 40 of FIG. 3.

Furthermore, in this embodiment, check valves 81, 82, 83 and 84 are disposed in the apparatus.

Check valves 81 and 82 communicate with gap 91, which communicates between adsorption chamber A and adsorption chamber B and the atmosphere. Check valve 81 is open when the pressure of gap 91 is over the required positive pressure, while check valve 82 is open when the pressure of the gap 91 is over the required negative pressure.

On the other hand, check valves 83 and 84 connect gap 92 which communicate between the adsorption chamber B and the adsorption chamber C with the suction passage communicating hole 14 and the fuel tank communicating hole 15. Check valve 83 is open when the pressure of gap 92 is over the required negative pressure, while check valve 84 is open when the pressure of gap 91 is over the required positive pressure. Like the check valve of FIG. 4, the check valves 81, 82, 83, and 84 are composed of rubber so as to open at a fixed difference in pressure.

The concrete operation of check valves 81, 82, 83, and 84 will be described below.

When adsorbing, fuel vapor is adsorbed in adsorption chamber A, adsorption chamber B, adsorption chamber C and adsorption chamber D, in that order, because switching valve 40 is closed, and because check valves 81, 82, 83, and 84 do not open as the pressure does not reach an amount sufficient to open the check valves because the amount of fuel vapor buildup is small. Therefore, the length of the charcoal is extended in the channel direction, and the leakage of fuel vapor to the atmosphere is favorably prevented.

When switching valve 40 releases gap 90 to the atmosphere when refueling, check valves 81 and 83 are open because of the high positive pressure caused by refueling. Adsorption chambers A, B, and C are structured in parallel so that the channel resistance is greatly reduced compared to the channel resistance during manual adsorption. The air in fuel tank 6 is discharged without hindrance through the adsorbent, then the fuel vapor which follows the air is adsorbed by the adsorbent.

When the engine is operating, switching valve 40 is closed. Moreover, as the check valves 82 and 84 are open because of the negative pressure for suction passage communicating hole 14, adsorption chambers C and D which are connected in series are connected to either of adsorption chamber A or B in parallel so that the channel resistance is lowered.

Figure 6:
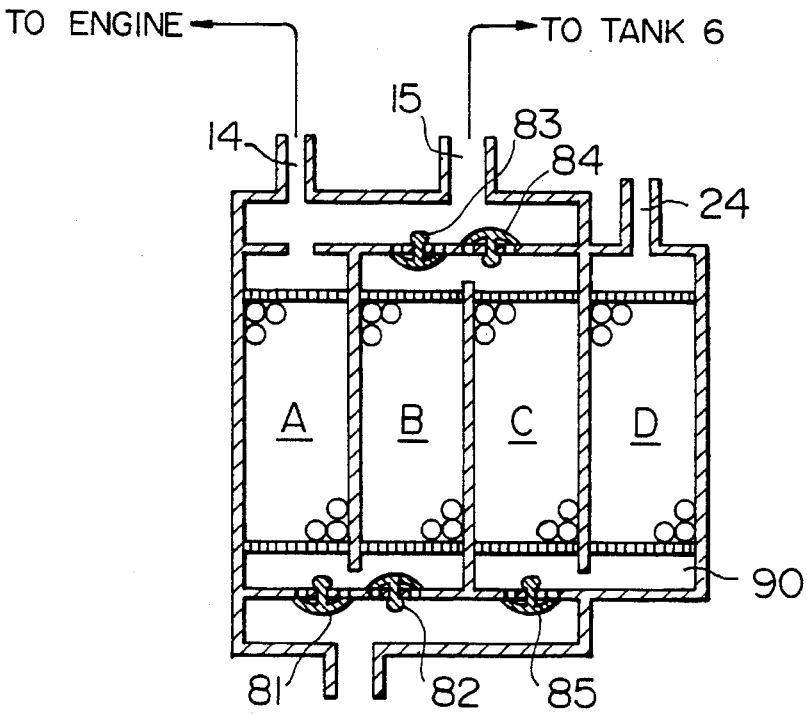
FIG. 6 is a schematic cross sectional view of the sixth embodiment of the present invention.
Figure 7:
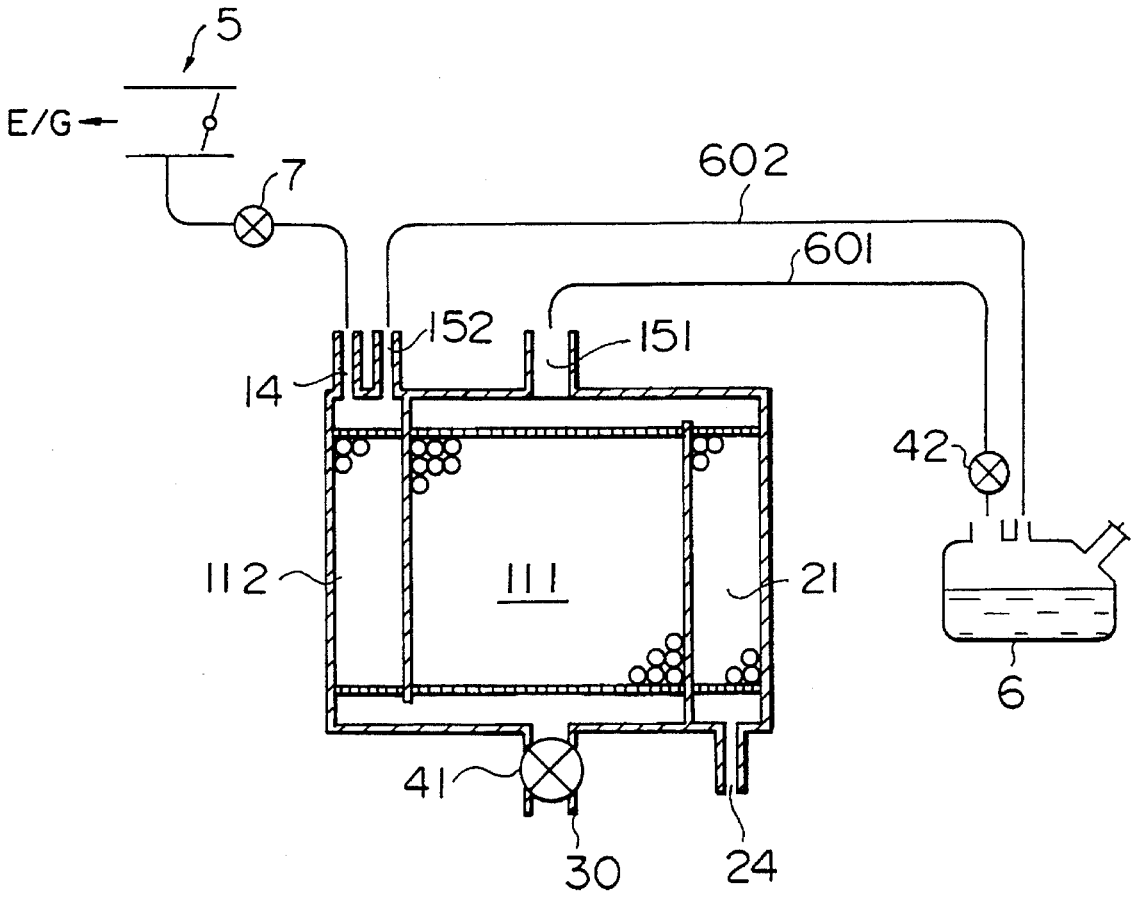
FIG. 7 is a schematic cross sectional view of the seventh embodiment of the present invention.

The sixth embodiment of the present invention will be described below with reference to FIG. 6 again with like elements being represented by like reference numerals.

The canister for a vehicle according to the sixth embodiment is the same as that of the fifth embodiment except that switching valve 40 of the fifth embodiment is replaced by check valve 85. Check valve 85 is open only in the case where the pressure of gap 90 is greater than the required positive pressure when refueling, and check valve 85 operates in the same manner as does switching valve 40. Changing switching valve 40 to checking valve 85 is similar to the situation of alternating switching valve 40 of FIG. 3 to check valve 8 of FIG. 4.

The seventh embodiment of the present invention will be described below with reference to FIGS. 7 to 10, again with like reference numerals representing like elements.

In consideration of the vapor adsorption in the adsorption portion (activated charcoal) and the return of the adsorbed vapor to the fuel tank at times other than refueling, in this embodiment, inner adsorption portion 11 is divided into two parts: first inner adsorption portion 111 and second adsorption portion 112. The configuration of first inner adsorption portion 111 is equal to that of inner adsorption portion 11 of each embodiment mentioned above. The configuration of second inner adsorption portion 112 is equal to that of outer adsorption portion 21.

Suction passage communicating hole 14 communicates only to the second inner adsorption portion 112 directly. The fuel tank communicating hole is divided into first fuel tank communicating hole 151 and second fuel tank communicating hole 152. First fuel tank communicating hole 151 communicates directly with both first inner adsorption portion 111 and outer adsorption portion 121. First fuel tank communicating hole 151 is connected to fuel tank 6 via first conduit 601, in the middle of which is disposed second switching valve 42. Second fuel tank communicating hole 152 communicates only to second adsorption portion 112 directly. Second fuel tank communicating hole 152 is connected to fuel tank 6 via second conduit 602.

First switching valve 41 and second switching valve 42 are open after receiving a refueling signal. In addition, these first and second switching valves can be formed as to be operated by a manual switch. Further, it may be applicable to use an electromagnetic three-way valve, a check valve, and so on instead of these valves.

The operation of a canister for a vehicle with the aforementioned structure is described below.

When refueling, first and second switching valve 41 and 42 are open so that most of the gasoline vapor produced when refueling goes through first inner adsorption portion 111 which has small channel resistance and branch pipe 30. The fuel of the gasoline vapor is adsorbed in first inner adsorption portion 111, with only cleaned vapor being discharged from branch pipe 30. This allows the pressure rise in canister 1 when refueling to be controlled.

The operation peculiar to the seventh embodiment will be described below.

After refueling is completed, each of switching valves 41 and 42 are closed. Consequently, on the occasions when the internal pressure of fuel tank 6 is raised according to the temperature rise in fuel tank 6, thus introducing vapor from fuel tank 6, the vapor is adsorbed in the second inner adsorption portion 112 via the second fuel tank communicating hole 152. Further, during evening or other times when internal pressure of fuel tank 6 is lowered (becomes negative) according to the temperature drop in fuel tank 6, atmosphere is introduced from the atmosphere communicating hole 24. With this atmosphere, the vapor which diffused from the adsorption portion returns to fuel tank 6 via second communicating hole 152. In the situation that a vehicle is left, the above mentioned adsorption and diffusion are repeated. Therefore, in the seventh embodiment, at times except for refueling, the vapor is adsorbed and diffused by the adsorption portion which has a small channel area in contrast to the situation when refueling. This is based on the following points.

Figure 8:
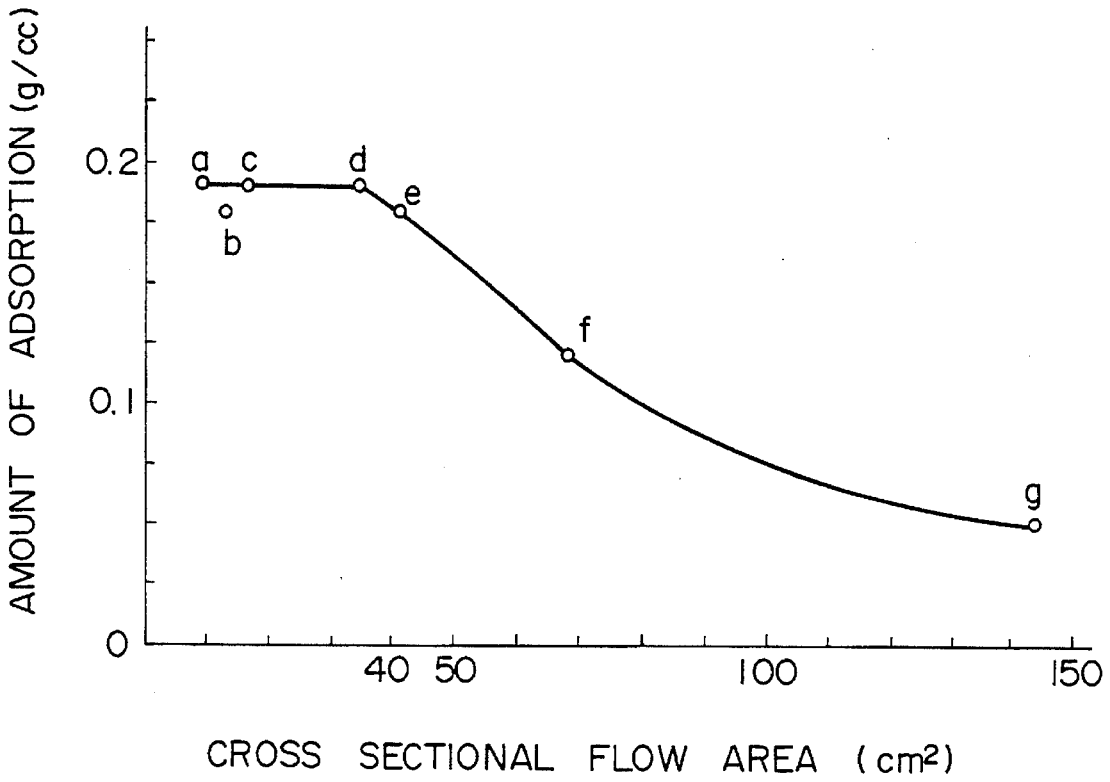
FIG. 8 is a graph showing vapor adsorption quantity per activated charcoal quantity relative to the cross sectional area of the channel.
Figure 9:
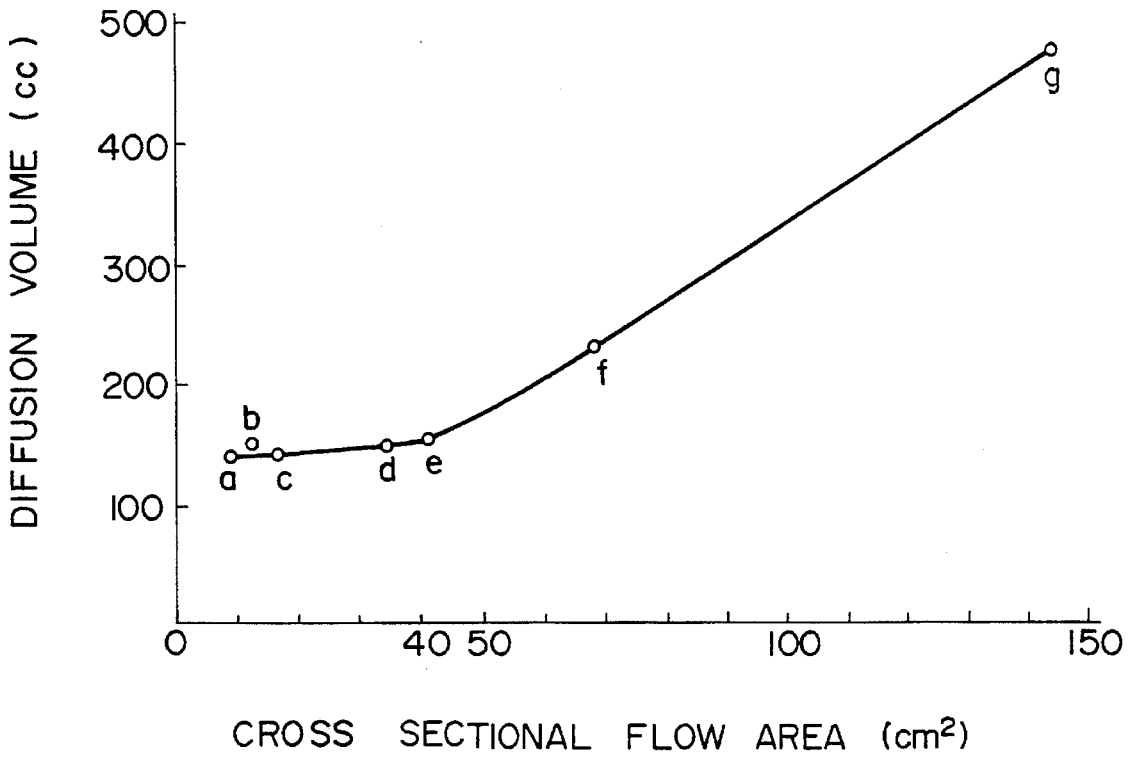
FIG. 9 is a graph showing the diffusion capacitance relative to the cross sectional area of the channel.

By investigating the vapor adsorbing condition from fuel tank 6 in the different cross-sectional area of the channel in the adsorption portion, the graph of FIG. 8 is obtained with respect to samples "a" through "g". From the graph, the smaller the cross-sectional area of the channel, the more the vapor adsorption quantity per activated charcoal. Further, the graph of FIG. 9 is obtained after studying how much the inflow vapor, which is gained by flowing an appointed amount of vapor into the activated charcoal and then stopping the inflow, is diffused to the activated charcoal without any adsorption. This graph of FIG. 9 indicates that the smaller the cross-sectional area of the channel, the smaller the volume of the activated charcoal to which vapor is diffused, that is, the harder the vapor is diffused.

Figure 10:
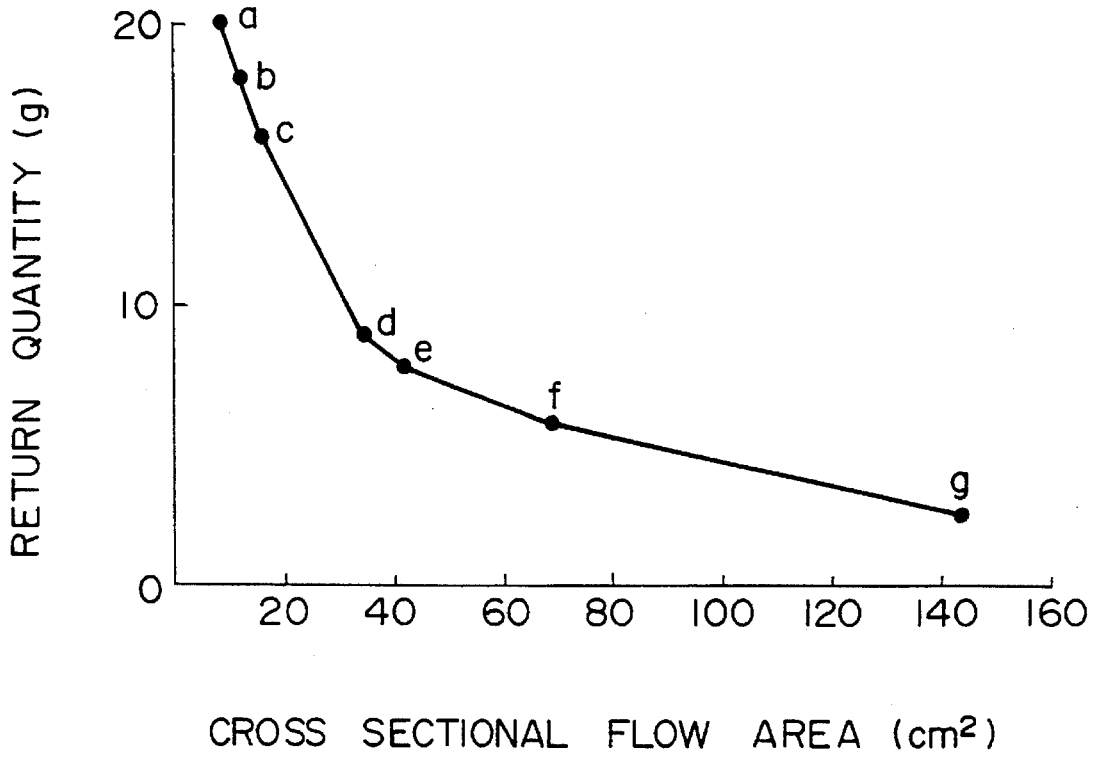
FIG. 10 is a graph showing the quantity of vapor returning to the fuel tank relative to the cross sectional area of the channel.

Moreover, the graph of FIG. 10 is obtained after investigating how much of the fuel, which is adsorbed in the adsorption portion, returns to the fuel tank 6 by using different cross-sectional area for the channel in the adsorption portion. This graph of FIG. 10 shows that the smaller the cross-sectional area of the channel, the more the vapor returns to the fuel tank.

At times except during refueling, which requires control of the pressure rise, the cross-sectional area of the channel in the adsorption portion is made small. According to the above-mentioned structure, the vapor produced by the temperature rise is favorably adsorbed by the second inner adsorption portion 112 so that the diffusion of the adsorbed fuel is suppressed, and the fuel vapor is prevented from diffusing to the atmosphere even if the vehicle is left for a long time. The amount of vapor which returns to fuel tank 6 due to the temperature drop can be increased. Therefore, the vapor can be easily prevented from overflowing from atmosphere communicating hole 24 after adsorption and diffusion of vapor are repeated for several days. That is to say, there is no need to enlarge the capacity of the adsorption portion for preventing overflow, and miniaturization of the adsorption portion can be achieved.

Figure 11:
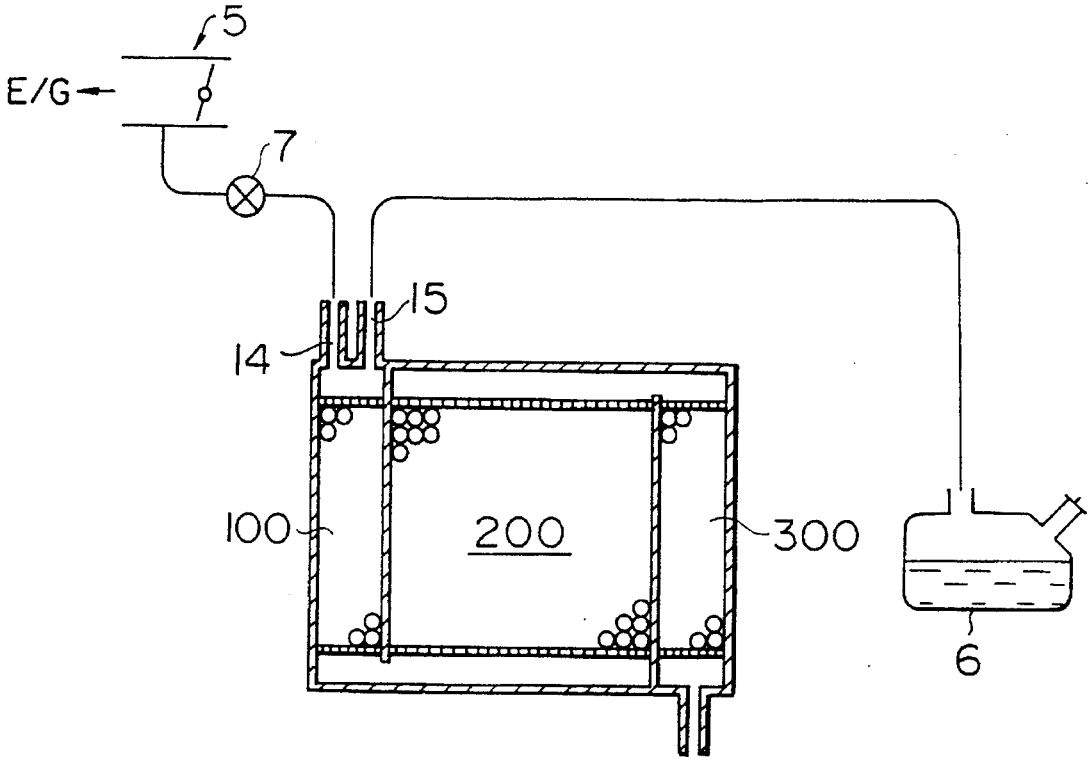
FIG. 11 is a schematic cross sectional view of the eighth embodiment of the present invention.
Figure 12:
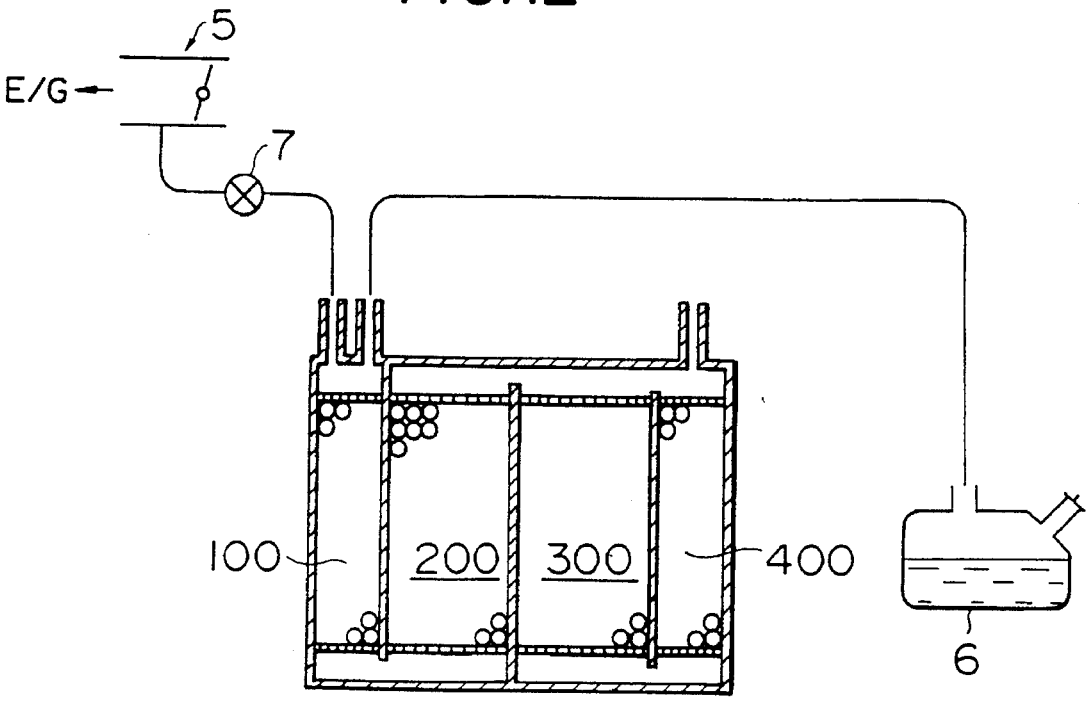
FIG. 12 is an another schematic cross sectional view of the eighth embodiment of the present invention.

According to the above-mentioned seventh embodiment, also shown in the graphs of FIGS. 8 to 10, only the structure with a small channel area of the adsorption portion on the fuel tank 6 side can be effective. That is, as shown in FIG. 11 as the eighth embodiment, it may be applicable to have an activated charcoal layer 100, the channel area of which is smaller than that of an activated charcoal layer 200, disposed on the side of the fuel tank 6. It may also be applicable to have the structure excluding the switching valve which opens during refueling because, with this structure, an effect as good as the above- mentioned effect at times other than refueling results. Accordingly, the channel area of the activated charcoal layer 100 on the side of the fuel tank 6 should be smaller than the channel area of the activated charcoal layer on the side of the atmosphere communicating hole 24. Also as shown in FIG. 12, although not limited the number of activated charcoal layers 200 and 300, the channel areas of which on the side of the fuel tank 6 are large, may be two.

The present invention has been described in connection with what are presently considered to be the most practical and preferred embodiments. However, the invention is not meant to be limited to the disclosed embodiments, but rather is intended to include all modifications and alternative arrangements included within the spirit and scope of the appended claims.

What is claimed is:

1. A canister system for a vehicle having a fuel tank and an engine with an intake air passage, said system comprising:

casing means having an inner space;

an intake communication port provided on said casing for communicating said inner space to said intake air passage;

a tank communication port provided on said casing for communicating said inner space to said fuel tank;

an atmospheric communication port provided on said casing for communicating said inner space to atmosphere;

inner adsorbent means for adsorbing fuel vapor evaporated in said fuel tank, said inner adsorbent means being encased in said casing means and separating said intake communication port and said tank communication port from said atmospheric communication port;

outer adsorbent means for adsorbing said fuel vapor, said outer adsorbent means being encased in said casing means and separating said inner adsorbent means from said atmospheric communication port; and valve means for communicating said inner space between said inner adsorbent means and said outer adsorbent means to said atmosphere at the time of refueling said fuel tank, wherein said outer adsorbent means has a flow passage resistance larger than that of said inner adsorbent means.

2. A system according to claim 1, wherein said casing means includes:

an inner casing encasing said inner adsorbent means therein;

an outer casing encasing said outer adsorbent means therein; and a connection passage communicating said inner casing and said outer casing and receiving said valve means thereat.

3. A system according to claim 1, wherein said inner space is partitioned into a plurality of spaces which are communicated serially, and wherein said casing means is provided with said intake communication port, said tank communication port and said atmospheric communication port at its one end and with said valve means at its other end opposite to said one end.

4. A canister system for a vehicle having a fuel tank and an engine with an intake air passage, said system comprising:

casing means having an inner space;

an intake communication port provided on said casing for communicating said inner space to said intake air passage;

a tank communication port provided on said casing for communicating said inner space to said fuel tank;

an atmospheric communication port provided on said casing for communicating said inner space to atmosphere;

inner adsorbent means for adsorbing fuel vapor evaporated in said fuel tank, said inner adsorbent means being encased in said casing means and separating said intake communication port and said tank communication port from said atmospheric communication port;

outer adsorbent means for adsorbing said fuel vapor, said outer adsorbent means being encased in said casing means and separating said inner adsorbent means from said atmospheric communication port; and valve means for communicating said inner space between said inner adsorbent means and said outer adsorbent means to said atmosphere at the time of refueling said fuel tank, wherein said inner space is partitioned into a plurality of spaces which are communicated serially, said casing means is provided with said intake communication port, said tank communication port and said atmospheric communication port at its one end and with said valve means at its other end opposite to said one end, and wherein said intake communication port and said tank communication port are formed on one end side of said inner adsorbent means, wherein said valve means is provided at the other end side of said inner adsorbent means, and wherein said atmospheric port is formed at one end side of said outer adsorbent means.

5. A system according to claim 1, wherein said valve means includes an electromagnetic valve.

6. A system according to claim 1, wherein said valve means includes a check valve which opens at a predetermined positive pressure.

7. A canister system according to claim 1, wherein said inner adsorbent means comprises:

a first inner adsorbent encased in said casing means and facing said tank communication port at its one end side, said first inner adsorbent adsorbing fuel vapor evaporated in said fuel tank; and a second inner adsorbent encased in said casing means for adsorbing said fuel vapor, said second inner adsorbent communicating with the other end side of said first inner adsorbent at its one end side and facing said intake communication port at its other end side, and wherein said outer adsorbent means comprises:

an outer adsorbent encased in said casing means for adsorbing said fuel vapor, said outer adsorbent communicating with said first inner adsorbent at its one end side and facing said atmospheric port at its other end said.

8. A system according to claim 7, wherein said second inner adsorbent has a cross section of flow passage which is 40 $cm^2$ or less.

9. A system according to claim 7, further comprising:

a second tank communication port provided on said casing means for communicating said inner space to said fuel tank, and wherein only said first tank communication passage communicates with said fuel tank at the time of refueling said fuel tank.

10. A canister comprising:

first means having a first adsorbent for removing fuel vapor from an airflow from a fuel source;

second means having a second adsorbent for removing fuel vapor from said airflow from said first means;

valve means for regulating said airflow from said first means to said second means and for allowing said airflow to only pass through said first removing means before exiting said canister during a refueling process, said valve means connecting said first and second removing means;

said first means being connected to an engine and said fuel source;

said second means being connected to an exterior atmosphere; and said second adsorbent having a flow passage resistance larger than that of said second adsorbent.

11. A canister according to claim 10, wherein said first removing means includes a plurality of compartments, said plurality of compartments being interconnected serially.

12. A canister according to claim 11, further comprising second valve means for controlling communication between said plurality of compartments.

* * * * *